US005858156A

United States Patent [19]

Abrams et al.

[11] Patent Number: 5,858,156

[45] Date of Patent: Jan. 12, 1999

[54] DIMINISHING BLEED PLUSH TRANSFER

[75] Inventors: Louis Brown Abrams; Glenn Peter Alban, both of Larimer County, Colo.

[73] Assignee: High Voltage Graphics, Inc.

[21] Appl. No.: 24,447

[22] Filed: Feb. 17, 1998

[51] Int. Cl.[6] ..... B44C 1/165; A46D 1/00; B05D 1/14; B05D 1/04

[52] U.S. Cl. ..... 156/230; 156/72; 156/237; 156/240; 156/241; 427/200; 427/206; 427/458; 427/462; 428/90

[58] Field of Search ..... 156/62.2, 63, 72, 156/150, 151, 230, 231, 235, 237, 238, 239, 240, 241, 247, 277, 276; 427/196, 200, 202, 206, 457, 458, 462, 463, 464, 465, 472, 473, 474; 428/90

[56] References Cited

U.S. PATENT DOCUMENTS

| | | | |
|---|---|---|---|
| 2,636,837 | 4/1953 | Summers | 154/123 |
| 3,657,060 | 4/1972 | Haigh | 161/73 |
| 3,793,050 | 2/1974 | Mumpower, Jr. | 117/17.5 |
| 3,816,211 | 6/1974 | Haigh | 156/309 |
| 3,956,552 | 5/1976 | Geary | 428/88 |
| 4,034,134 | 7/1977 | Gregorian et al. | 428/86 |
| 4,142,929 | 3/1979 | Otomine et al. | 156/72 |
| 4,273,817 | 6/1981 | Matsuo et al. | 428/90 |
| 4,292,100 | 9/1981 | Higashiguchi | 156/72 |
| 4,385,588 | 5/1983 | Bennetot | 118/638 |
| 4,396,662 | 8/1983 | Higashiguchi | 428/90 |
| 4,668,323 | 5/1987 | Lenards et al. | 156/242 |
| 4,741,791 | 5/1988 | Howard et al. | 156/72 |
| 4,810,549 | 3/1989 | Abrams et al. | 428/88 |
| 5,008,130 | 4/1991 | Lenards | 427/206 |
| 5,047,103 | 9/1991 | Abrams et al. | 156/72 |
| 5,207,851 | 5/1993 | Abrams | 156/230 |
| 5,346,746 | 9/1994 | Abrams | 428/195 |

FOREIGN PATENT DOCUMENTS

| | | | |
|---|---|---|---|
| 2065031 | 6/1981 | United Kingdom | B44C 1/16 |
| 2126951 | 4/1984 | United Kingdom | B41N 1/00 |
| PCT/US88/02828 | 8/1988 | WIPO . | |

*Primary Examiner*—David A. Simmons
*Assistant Examiner*—Jerry A. Lorengo
*Attorney, Agent, or Firm*—Paul M. Denk

[57] ABSTRACT

A method of producing an plush transfer appliqué is disclosed. The method employs and improved diminished bleed or lower density appliqué border allowing for a reduction or elimination of an impression line at the periphery of the transferred appliqué caused by the heat transfer process. The diminished bleed appliqué border is created by arranging a pattern at the edge or periphery of the transferred appliqué instead of an abrupt line of continuous density fiber, so that the resulting gradual reduction in fiber density causes the fibers to lie flat during the heat transfer process.

5 Claims, 2 Drawing Sheets

DIMINISHING BLEED PLUSH TRANSFER

BACKGROUND OF THE INVENTION

1. Field of the Invention

The invention generally relates to a method of manufacturing flock transfers and appliqués. Specifically, the invention is directed to methods of manufacturing flock transfers which exhibit an enhanced texture, particularly flock transfers composed of a plurality of precolored flock. More particularly, the present invention is directed to improved decorative appliqués composed of flock, having a tapered edge, thereby reducing or eliminating any impression lines typically created during the transfer procedure.

2. Description of the Prior Art

Appliqués are conventionally manufactured by processes which involve embroidery, screen printing and flocking. Embroidered appliqués are made by stitching designs with thread into a fabric base material, and then cutting the appliqué out of the material. Later a stitching can be added to the edge of the material for a more finished-looking product. Examples can be found in U.S. Pat. Nos. 3,657,060 and 3,816,211. Embroidered appliqués suffer from disadvantages including being the most expensive type of appliqué to produce, in addition to being slow to produce because of the speed of the looms. Moreover, it is difficult or impossible to achieve fine detail in the designs because of the limitations in the stitching process.

Screen printed appliqués are made by screen printing textile inks directly onto a textile, and then cutting out the appliqué. In the alternative, a pre-cut textile appliqué, with or without a stitched edge, can be screen printed. Screen printed appliqués are perceived as being an inferior products relative to an embroidered appliqué because they can lack three-dimensionality, rich texture, brilliant appearance, and wash-fastness. Appliqués made by flocking are conventionally made by screen printing a flocking adhesive onto a textile surface; applying flock fibers by vibration, gravity, or electrostatic charges; drying the adhesive and vacuum cleaning excess flock fibers away; cutting the appliqué into a desired shape; and stitching the edge for a finished look. There are two basic methods of applying flock to a surface. The first method is referred to as direct flocking. The second is by means of flock transfers. In the former instance, the flock is applied directly to the surface that forms the finished product. Usually wallpaper, carpets and decorative elements of garments are produced in this manner. An example of direct flocking is found in U.S. Pat. No. 3,793,050 to MUMPOWER. This particular direct flocking method allows the use of different color and size of flock in the same design surface to be flocked. Each color of flock is passed through a screen that restricts that color to the desired part of an adhesive layer. A multicolor flock design is thus obtained on the surface on the substrate being flocked. Multicolor direct flocking suffers a number of disadvantages. It is an exacting procedure with many variables to be controlled requiring specialized flocking equipment and an environment that is controlled for relative humidity. During the startup of such a procedure many reject-quality articles may result as the variables are adjusted by trial and error until the desired result is found. Further, if the article to be decorated has an uneven surface like many textiles, then density of the flock, control, speed and the quality of the finished design i.e. sharpness of lines separating colors, vivid images, etc., would be adversely affected. It is believed that direct flocking has been limited in use in the United States. Examples of flock transfers or appliqués, i.e., the second method of employing flock fibers in a decorative manner, are illustrated in U.S. Pat. No. 4,142,929, to OTOMINE, U.S. Pat. Nos. 4,292,100 and 4,396,662 both to HIGASHIGUCHI and U.K. Pat. application No. 2,065,031 to MAITLAND and U.K. Pat. application No. 2,126,951 to TRANSWORTH. Transfers are formed by applying flock to a release sheet having a temporary release adhesive coating. The flock is then colored with different color inks and coated with a binding layer and hot melt adhesive in a desired decorative design. The transfers are applied to articles using heat and pressure. The release sheet is peeled away leaving a finished decorative design. Conventional multicolor flock transfers also suffer from a number of disadvantages. The basic underlying problem is that the flock transfers use a very short fiber and are, therefore, relatively flat so that a plush textured multicolored look is not achieved. Thus, a transfer having a richly textured appearance has not been achieved using flock to justify the additional cost over conventional screen printing. Flock fibers of conventional multicolor flock transfers must be short because of a fundamental limitation of conventional flock transfer manufacturing methods caused by the problem of penetrating the flock fiber with printing ink to form the desired design. Typical flock fibers used in multicolor flock transfers are only about 0.3 mm long because if fibers longer than about 0.3 mm are used, it is difficult for subsequently applied ink to penetrate along the full length of the fibers; when a sufficient amount of ink is supplied to do so there results a smudged design. This is unlike direct flocking which can use precolored flocks of approximately 0.5 mm to 3 mm in length. In conventional direct flocking procedures, prior to the inventions disclosed and claimed in U.S. Ser. No. 88,292 and PCT Application No. PCT/US88/02828, as well as the inventions disclosed in this application, it is extremely difficult to achieve fine, clear detailed designs by direct flocking onto textiles because the results are dependent on procedures that are difficult to control, and the textile surface is uneven. It is also difficult, for the same reasons, to control the wash-fastness or durability of direct flocked appliqués.

The transfers or appliqués produced by traditional or conventional flock heat transfer methods are made by heat transferring the flock image to a textile, removing the heat transfer carrier paper, and cutting out the appliqué from the textile, then stitching the edge. Traditional flock heat transfer appliqués, however, have not been successful because of a lack of texture, brilliance, and wash-fastness or durability. Further, the application of conventional flock heat transfers is limited to certain types of surfaces and therefore flock heat transfers have limited commercial uses. Moreover, flock transfers and appliqués in accordance with the present invention are esthetically superior to conventional flock transfers and appliqués in that the inventive transfers and appliqués appear more similar to a woven fabric because the individual fibers of the flock are precolored before flocking in contrast to conventional flock transfer techniques wherein the flock transfer is printed with colors to form the desired design. Thus, in flock transfers and appliqués in accordance with the present invention there is what can be referred to as point-by-point separation of color which causes a more vivid and distinct demarcation between areas of different color.

The present invention overcomes the aforementioned disadvantages of the previously discussed conventional methods of manufacturing appliqués. In particular, appliqués made in accordance with the present invention are advantageous because they can be produced more inexpensively than embroidery while offering finer design detail. In addition, the present invention has greater texture and durability than both traditional screen printed and flock heat transfer appliqués.

The present invention is especially well suited to application of transfers to delicate or sensitive materials such as acrylic and polyvinyl chloride (PVC or vinyl) without creating a sharp impression line at the perimeter of the transfer.

BRIEF DESCRIPTION OF THE INVENTION

The present invention is directed to a method of making an appliqué which involves applying a release adhesive upon a release sheet, for example using rollers, sprayers or screen printing; flocking flock through an open section of a barrier, such as mesh screen, into the adhesive to result in at least two patterns arranged to form a predetermined design adhered to the release sheet; applying a binding adhesive to free ends of the flock; transferring at least one of the predetermined designs of flock to a substrate material; and affixing the substrate material with the predetermined design of flock to an article. The present invention is also directed to an appliqué which is composed of a substrate material adapted to be affixed to an article and flock having end portions coated with a binder adhered to the substrate material. A pattern of dots, rows or columns is created at the perimeter of the flock transfer, thereby reducing the number of fibers at the edge of the transferred artwork. When the density of the fibers at the edge of the transferred artwork is effectively reduced in the above mentioned manner, the fibers at the perimeter of the transferred artwork tend to become crushed or flattened during the heat-pressing operation, and thus eliminating any impression line at the edge of the transferred artwork upon the material the artwork is being transferred to.

In accordance with the present invention, the substrate material is composed of a fabric selected from the group consisting of natural fibers, synthetic fibers and blends of natural fibers, blends of synthetic fibers, and blends of natural fiber and synthetic fiber, such as a member selected from the group consisting of a twill, a knit, a woven fabric, and a non-woven fabric, preferably wherein the fabric is constructed in a form selected from the group consisting of a roll of fabric, a fabric sheet, and precut sections of fabric, more preferably wherein the fabric is a blend comprising of natural fiber and synthetic fiber, and most preferably wherein the natural fiber is cotton and the synthetic fiber is polyester, in the form of a twill.

Preferably the substrate material has a surface area at least as large as the predetermined design, and more preferably has a surface area of at least twice as large as the predetermined design so that at least two of the predetermined designs may be transferred to the substrate material. The substrate material may be cut into pieces having finished edges to which at least one of the designs has been transferred. The edges of the pieces may be finished by a procedure selected from the group consisting of binding, merrowing, and stitching.

The substrate material may be cut into pieces prior to the transferring so as to precut the substrate material into a piece having a desired shape suitable for receiving one or another desired number of the predetermined designs of flock, or may be cut and finished after transferring. The cutting results in a plurality of desired shapes of substrate material preferably wherein each one has one of the predetermined designs of flock, in which case the finishing operation is completed before affixing the appliqué to an article. For purposes of the present invention, a hot melt adhesive, which is preferably selected from the group consisting of polyurethane, polyester and nylon, may be applied as a separate adhesive layer to the binding adhesive.

In accordance with the present invention, the flock is preferably conductive material, such as synthetic material, selected from the group consisting of acrylic, rayon, nylon, and polyester materials, and preferably nylon.

For purposes of the present invention, the flock include fibers longer than 0.3 mm, e.g., having a length which is most preferably within the range of 0.5–1 mm, but may have a length of at least about 0.5–3 mm up to about 5 mm, although fibers having a length greater than 5 mm up to about 1 cm may be used, with flock with fibers longer than 1 cm also envisioned as being suitable for producing flock transfers with a plush texture.

The release sheet is a material selected from the group consisting of paper, resin, plastic and metal foil and preferably is a dimensionally stable sheet of paper, which may be transparent, as well as polyester, polyethylene, polyurethane and other films, such as extruded sheets of material, which also may be preferably transparent.

The release adhesive may be applied in the form of a solution or emulsion, such as a resin or a copolymer, such as polyvinyl acetate, polyvinyl alcohol, polyvinyl chloride, polyvinyl butyral, acrylic resin, polyurethane, polyester, polyamides, cellulose derivatives, rubber derivatives, starch, casein, dextrin, gum arabic, carboxymethyl cellulose, rosin, or compositions containing two or more of these ingredients.

The binder adhesive is a resin, preferably selected from the group consisting of polyvinyl chloride, polyvinyl acetate, polyurethane, polyester polyamide, and acrylic resin, such as a water based acrylic resin, and may also include a hot melt adhesive, such as a hot melt adhesive selected from the group consisting of polyurethane, polyester and nylon, which is preferably applied as a separate adhesive layer.

DETAILED DESCRIPTION OF THE INVENTION

The present invention is directed to a method of manufacturing an appliqué which involves producing a flock transfer as an initial step. The production of a flock transfer suitable for purposes of the present invention is accomplished in accordance with the disclosure in U.S. Ser. No. 88,292 and PCT Application No. PCT/US88/02828, disclosures of which are hereby incorporated in their entirety by reference thereto herein. In accordance with the present invention, flock transfers are produced which may be plush in texture, multi-colored, or multi-colored and plush in texture.

Figure 1:
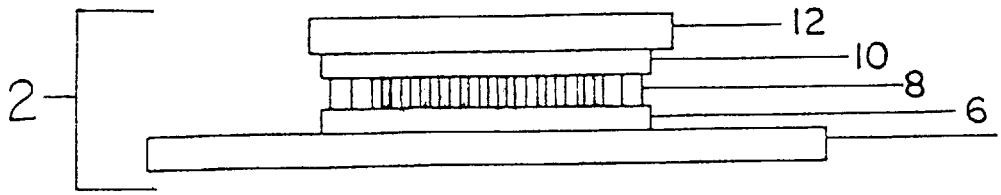
FIG. 1 is a cross section of the multicolor transfers in accordance with the present invention.

In this regard, the procedure used in the production of a flock transfer as the initial stage of the method of manufacturing an appliqué in accordance with the present invention shall be described in reference to the figures of the drawing. As shown in FIG. 1, the flock transfer 2 of the appliqué of the present invention comprises a release sheet 4, such as dimensionally stable paper or polyester film, to which a conventional flock transfer release adhesive 6, usually acrylic, is applied. A preferred release adhesive is commercially available as LR 100, manufactured by Societe D'Enduction et de Flockage. The release sheet, however, may be any material which can be suitably used with the adhesive which should be selected to effect temporary adhesion of the flock fibers. Although paper, such as dimensionally stable, processed paper, and plastic films are preferred, resin sheets and metal foils may also be employed. Depending on the desired effect and the sheet materials employed, the release sheet may be transparent, translucent or opaque, but is preferably transparent.

The release adhesive 6 may be applied in the reverse of a desired pattern, that is, a pattern which corresponds to the overall image which is to be flocked. Preferably, however, the release adhesive may be applied without regard to the overall design desired, for example by applying the released adhesive with rollers or spraying the release sheet with a coating of the release adhesive, particularly when the batches of flock having different fiber lengths and/or pre-colored flocks are sequentially applied to the adhesives, as discussed in more detail hereinbelow. The release adhesive may be applied in the form of a solution or emulsion, such as a resin or a copolymer, such as polyvinyl acetate, polyvinyl alcohol, polyvinyl chloride, polyvinyl butyral, acrylic resin, polyurethane, polyester, polyamides, cellulose derivatives, rubber derivatives, starch, casein, dextrin, gum arabic, carboxymethyl cellulose, rosin, or compositions containing two or more of these ingredients.

Figure 3:
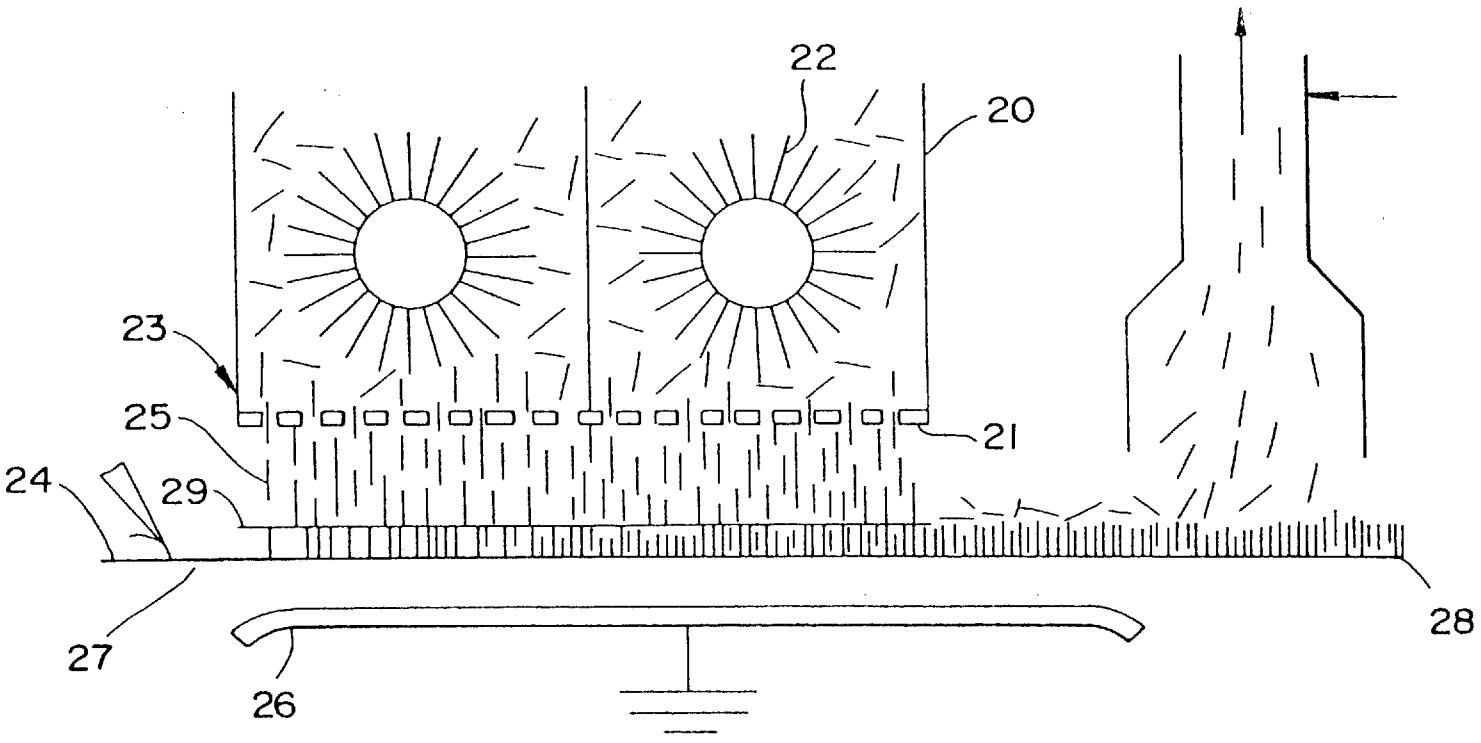
FIG. 3 is a schematic illustration of an electrostatic flocking apparatus used in accordance with the present invention.

The flock 8 is preferably composed of fibers, which may be referred to herein as flock fibers. The flock may be rayon, and other types-of conductive material, such as nylon, polyamide, polyester and similar synthetic fibers, with nylon being preferred, and is applied to the adhesive 6, such as activated adhesive, by electrostatic processes, spraying, or by gravity, such as sprinkling or vibrating the flock onto the surface of the base sheet provided with the release adhesive, with electrostatic flocking being preferred. In general, conventional electrostatic flocking utilizes a field of static electricity to orient fibers and promote their perpendicular alignment. This technique has been found to be particularly suitable for flocking with longer fibers in accordance with the present invention. In a method of electrodeposition used for purposes of the present invention an adhesive-coated release sheet is passed between the potentials of a high voltage electrostatic field. An electrode is utilized to give the flock a charge. The charged fibers become aligned with the electrical field lines of force. The ground potential is formed by the release sheet and/or the grounded parts of the machine. The flock is thus attracted to the adhesive where it becomes embedded. Most fibers adhering to the adhesive coated surface are perpendicular to it, thus resulting in a dense pile finish. Inasmuch as it is the nature of the field to align the fibers perpendicular to a surface, electrostatic flocking permits substantially any shape object to be flocked, may be used for a variety of objects. More specifically, referring to FIG. 3, flock fibers are dosed or dispensed from a hopper or box 20 by being physically pushed through a dispensing screen 21, which is preferably made of metallic mesh, by means of a rotating dosing brush 22, down into the electrostatic field and through barrier 29. The barrier 29 has an open section corresponding to a predetermined pattern of flock to be passed therethrough. The barrier 29, which is preferably a mesh screen, may also be referred to herein as the image screen. As shown, the image screen is located between the dispensing screen 21 of the hopper and substrate material 27. Preferably, the image screen is positioned closely adjacent the substrate material and more preferably is spaced from the substrate material by a distance which is about equal to the length of flock being applied to the substrate, and most preferably by a distance of about 110% of the length of the flock. In the most preferred instance, the binding adhesive is preferably applied to the substrate material to a thickness equal to less than about 10% of the length of the flock. The metallic dosing screen is connected to a high voltage source and is itself the high voltage electrode 23 giving the flock fibers a charge, either positive or negative. The charged fibers are then attracted to the counter potential, i.e., the screen and adhesive 24 below the screen. Fibers 25 are propelled by electrostatic counter potential attraction toward the grounded electrode, and they either then contact the screen and reverse polarity and are then propelled again towards the electrode screen or, if they are propelled into the adhesive 24, they become permanently lodged in it and remain there, eventually forming the flock coating on the adhesive coated fabric or substrate material 27. In accordance with the present invention, the flock becomes polarized, taking on both the charge of the electrode on one end and the counter potential charge on the other so it is no longer oscillating in the electrostatic field. The resultant flock has a electrically conductive chemical finish coating to enable it to become charged as well as to enable it to continually change charges back and forth from positive to negative thousands of times per minute. Thus, the flock oscillates back and forth between the electrode, i.e., the dosing screen, and the ground, i.e., image screen until it eventually finds a permanent location in the adhesive. The amount of flock therefore dosed into the electrostatic field is adjusted to be roughly equal to the amount which is taken out of the field or used by the printed adhesive, to avoid overdosing or crowding of the fibers in the field which may block the image screen or simply waste the flock. Up to 100,000 volts is used with very low amps, e.g., a maximum of 200 microamps with about 40,000 volts being preferred. The textile applications, 1 millimeter nylon flock with 3.3 Dtex (diameter) is preferred.

Referring back to FIGS. 1 and 2, the flock 8 of the flock covered release sheet 4 is then coated with a binder adhesive 10, such as a water based acrylic, which binds the flock into a unit and is a barrier for the hot melt. Preferably the binding adhesive is applied in the form of a solution or emulsion. The binder adhesive preferably contains a resin, such as polyvinyl chloride, polyvinyl acetate, polyurethane, polyester, polyamide, and acrylic resin, and preferably the previously mentioned water based acrylic. A preferred binder adhesive is commercially available as Tubitrans Bond manufactured by Chemische Fabrik Tubitrans R. Beitlich GmbH & Co. Turbitrans Bond is an acrylic dispersion which is cross-linkable at higher temperatures in the form of a high viscosity, white paste. The acrylic dispersion has a viscosity of cp. 4.5–4.6 measured with Contraves Viscometer, type Epprecht, Instrument and a pH of about 7–8. This acrylic resin dispersion may be mixed with Tubitrans Fix 2 and optionally further with a colormatch dyestuff. A preferred release adhesive, therefore, would be 100 parts Tubitrans Bond, 8 parts Tubitrans Fix 2, and 0–3 parts colormatch dyestuff. The binder adhesive 10 may contain additional or supplemental adhesives, such as a hot melt adhesive, usually a granular polyester or nylon, for binding the transfer to a substrate. Alternatively, the hot melt adhesive 12, may form a separate layer. The use of separate hot melt layers is preferable. In addition, other heat sensitive adhesives, such as polyvinyl chloride, thermoplastic acrylic resin, polyethylene, polyamide, polyurethane, paraffin and rubber derivative may be used for this purpose, with polyurethane being preferred.

In accordance with the present invention, in order to achieve a multicolor and/or textured effect, the flock 8 is applied through the image screen 29 which is preferably a gauze-like mesh screen made of polyester monofilament material. The multicolor effect is achieved by using different precolored flock. A textured effect is achieved by using flock fibers of different length wherein flock fibers of substantially the same or uniform length are passed in batches through the open section of the barrier. As used herein, precolored flock means that the flock has been colored before being flocked, adhered stuck or otherwise applied to the release adhesive. Depending on the overall design texture and the color or number of colors of flock which are to be used, an appropriate number of barriers or screens are prepared to have open sections to permit passage of flock in a predetermined configuration, texture pattern, and/or color pattern. Alternatively, a single screen may be sequentially masked for this purpose. In either case, the open sections of each mask or screen are designed to permit passage of flock fibers in a configuration which corresponds to areas of the final design which correspond to only one color and/or flock length, which is preferably one of a plurality of colors and/or fiber lengths of a color and/or texture pattern, intended to be used in the final or overall design. The screen also serves to mask areas which are not intended to receive a particular color or texture. In accordance with the present invention, each different color and/or different length of flock is preferably applied sequentially using a different screen to result in the particular precolored flock and/or flock of predetermined length passing through the open section of the screen onto a corresponding section of the release adhesive 6 to form a color and/or texture pattern. In either case, the edge or periphery of the desired transfer is masked with a pattern that gradually reduces the density of the flock from full density to near zero density.

Figure 4:
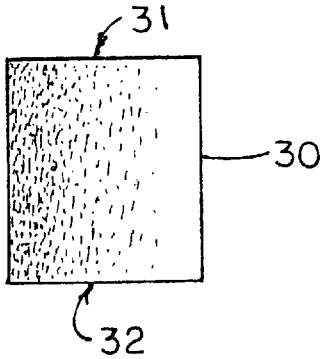
FIG. 4 is a plan view of an edge section of an appliqué made in accordance with the present invention.

Referring to FIG. 4, an area of a transfer 30 is shown with full density flock 31 gradually reduced to lowest density of flock 32. In the preferred embodiment, the edge or periphery of the transfer is decreased from full density to lowest density in a width of approximately 3/16".

In the preferred embodiment wherein multi-color flock transfers are made from precolored flock, inasmuch as the precolored flock which form the color pattern do not require being printed with ink following flocking in order to effect different colors, as in a conventional multicolor transfer, the length of the flock can be as long as practical for the transfer depending on the desired aesthetic effect. In this regard, the flock fibers may be substantially longer than 0.3 mm, or even longer than 0.5–1 mm, the main limiting concern being the plushness of the texture of the flock transfer and the desired aesthetic effect which is intended to be achieved. Thus, flock transfers having a fiber length of within the range of 1 mm up to 5 mm, and longer, can be used to result in a flock transfer which is much more plush, vivid and three dimensional than flock transfers wherein shorter fibers, i.e. 0.3 mm are used. In accordance with a preferred embodiment of the present invention, however, flock having a fiber length within the range of 0.5 mm to 1 cm are preferred.

In other respects, however, the present invention utilizes conventional materials and flocking techniques as disclosed in U.S. Pat. Nos. 3,793,050 and 4,292,100, the disclosures of which are hereby incorporated in their entirety by reference thereto; and U.S. Pat. application Nos. 2,605,031 and 2,126,951.

Figure 2:
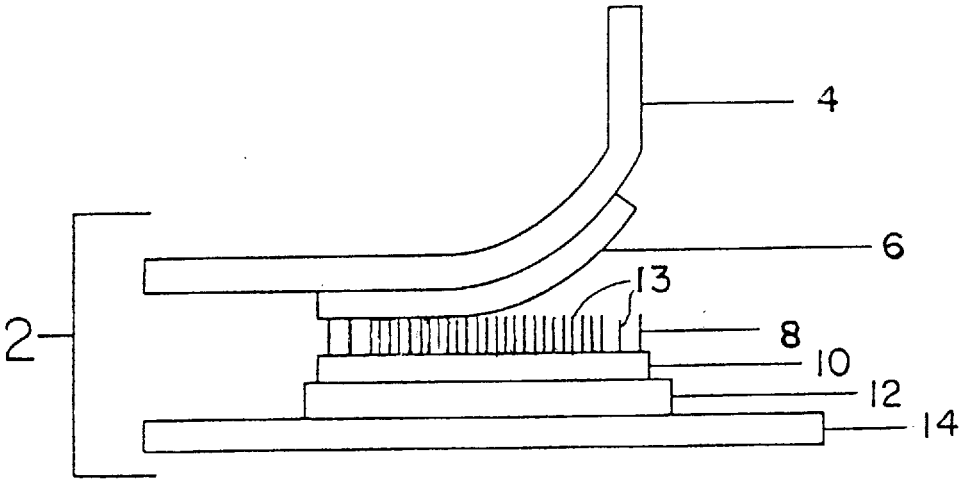
FIG. 2 is a cross section of the multicolor transfer in accordance with the present invention illustrated in FIG. 1 showing its application to a textile or fabric.

FIG. 2 illustrates the application of the transfer to a substrate material such as a fabric or textile 14 which, if suitably sized and shaped, for example by cutting, is referred to herein as a base sheet of the resultant appliqué which is adapted to be affixed to the surface of an article, as described in more detail herein below. Alternatively the flock transfer, as defined above, may be applied directly to the surface area of an article, which may also be referred to herein as a substrate material, which is preferably a fabric or textile in a finished form of, for example a garment.

In accordance with the present invention, the material of the substrate, i.e., fabric or textile, can have a relatively smooth, regular surface, such as a piece of cloth, or may have a textured or irregular surface, such as fishnet material. In accordance with the embodiment of the present invention directed to an appliqué, the substrate material may be in the form of a roll or sheet of plain textile made of natural or synthetic fibers or blends of natural and synthetic fibers. The substrate may be constructed as a twill, knit, woven fabric, or non-woven fabric. Preferably the substrate is a cotton and polyester twill blend. In the embodiment of the present invention directed to an appliqué, the substrate may also include a layer of hot melt adhesive on its back side for iron-on application of the appliqué. In the embodiment of the present invention directed to an appliqué, the substrate may also be pre-cut into a desired shape and may have an edge finished by a process such as stitching, merrowing, or binding with thread. If the substrate is not pre-cut, then it may be cut into a desired shape after heat transferring, in which case the edges are then finished.

In accordance with the present invention the transfers and appliqués may be applied to a surface area of any type of article, but preferably a garment or piece of wearing apparel, to which it is desired to affix or imprint a word, design, logo, emblem or other sign or symbol, particularly shirts, jerseys, jackets, pants, shorts and caps, such as those designed to be worn during athletic activities, e.g., U.S. football jerseys and baseball caps.

Moreover, although flock transfers and appliqués are normally applied to substantially flat surfaces of a garment, the flock transfers and appliqués of the present invention are particularly suitable for the application of a flocked design to a curved or undulating surface without adversely affecting the vividness or other characteristics of the flocked design. Thus, the flock transfers and appliqués of the present invention are advantageous in that they can be applied to almost any type of surface regardless of its texture or configuration. For example, although many textiles or fabrics to which flock designs are transferred may have a close-knit weave, the flock transfers of the present invention may be applied to fishnet and open mesh fabrics as well.

To this end, the hot melt surface 12 is placed against a substrate material 14. Heat and pressure is applied to the release sheet 4 in order to bond the transfer to the substrate material. The release sheet 4 with the, adhesive 6 is then pulled away from the flock 8. This leaves a transfer permanently affixed to the substrate material.

In accordance with the preferred embodiment of the present invention directed to the appliqué, the substrate material 14 may then be affixed to the surface of an article, for example by a technique such as sewing the appliqué onto the article or ironing it on, particularly where the article is a textile, or applying a melt adhesive to the back of the appliqué which in turn is fastened to the article which may be made of metal, plastic or other composite material. This may be done by manufacturers or by consumers. The ability to sew these appliqués is particularly advantageous because of the common familiarity with sewing versus iron-on application.

Although the invention utilizes conventional materials and techniques which can be generally found in various references, the specific manner by which the method of the present invention is performed permits a much longer flock than heretofore was practical to be used in all except direct flocking techniques so that the particular combination of elements and the manner by which they are combined in accordance with the present invention produces a unique and superior flock transfer and appliqué.

The finished appliqué may be applied to articles by either sewing the appliqué onto the article or ironing it on, as well as using adhesives or other known means for application.

The present invention has significant advantages over direct flocking. These advantages include flocking onto an even surface (release sheet) instead of an uneven surface (textile) thereby making it possible to achieve higher density; the permanence of the flock surface is not dependent upon the ability of the fibers to penetrate and anchor themselves in the flock adhesive in direct flocking, but with the present invention an even layer of binder adhesive is screen printed into the tips of the flock fibers with controlled penetration; and unlike direct flocking, the edges of the flocked image form a clear line because all the fibers are on top of the adhesive at substantially 90 degree angles to the substrate. In direct flocking, the fibers will coat the adhesive at every contact point, including the sides of the adhesive layer. The extreme edges of the adhesive layer will have a very low density, approaching zero due to the pattern at the periphery of the image.

EXAMPLE 1

The following, for purposes of illustration, is an example of a method of producing the appliqués of the present invention. An acrylic release adhesive layer 6 of LR 100 is applied in the reverse of a predetermined pattern to a dimensionally stable base sheet 4, such as bond paper. A first color of nylon flock fibers 8 have a length of about 1 mm is passed through a monofilament polyester screen for 10 to 15 seconds in an electrostatic field. The screen has open sections in those areas which correspond to the colored section of the reversed design. At the edge, border or periphery of the open sections of the screen defining the reversed design a pattern 13 of dots, rows or columns is added, extending substantially completely around the reversed design. Inasmuch as the acrylic release adhesive 6 acts as a ground for the charged particles, the ends 8*a* of flock 8 becomes embedded in the release adhesive layer 6 at substantially 90°. This procedure is then followed for each succeeding color of nylon flock fibers 8 that are to be electrostatically flocked in order to form the desired design, after which the resultant unit is dried. The tips of the exposed flock 8 are printed using conventional screen printing equipment with a water based (40–60% water) acrylic binder 10. The binder 10 binds the flock 8 to the hot melt and forms a barrier between hot melt and flock to prevent matting of the fibers, and further provides opacity and brilliance by reflecting light. The binder 10 is dusted or powdered with a polyester hot melt adhesive 12 and the transfer is air dried or macrowave dried. After brushing and vacuuming excess adhesive 12, the transfer is placed in an infrared dryer for about 2–3 minutes to sinter the hold melt powder and cross link the binder 10 and adhesive 12 to form a multicolor flock transfer. The transfer is applied to a substrate or base sheet, e.g., the appliqué textile, i.e., the permanent appliqué base 14 by positioning the adhesive surface 12 over the substrate. A hot surface such as a hand iron heated to a temperature of 300–350 degrees F. is pressed against the paper for about 15 to 25 seconds. The transfer is allowed to cool, preferably to an extent that the hot melt adhesive resolidifies so that it can be manipulated by hand, and the paper 4 and release adhesive 6 are removed by peeling the paper 4 from the flock 8. The desired flock design is thus transferred and permanently affixed to the substrate. The substrate or base sheet 14 may then be cut into a desired shape and the cut edges are then finished by merrowing. The finished appliqué can then be affixed to a garment by sewing the substrate or base sheet onto the garment to provide a decorative effect.

EXAMPLE 2

The following is an illustrative example of a method of producing the flock transfers for purposes of the invention comprises. An acrylic layer 6 is applied in the reverse of a predetermined pattern to a dimensionally stable base sheet 4, such as a bond paper. A first color of nylon flock fibers 8 having a length of about 5 mm is passed through a monofilament polyester screen for ten to fifteen seconds in an electrostatic field. The screen has open sections in those areas which correspond to the first colored section of the reversed design. At the edge, border or periphery of the open sections of the screen defining the reversed design a pattern 13 of dots, rows or columns is added, extending substantially completely around the reversed design. Inasmuch as the wax acts as a ground for the charged particles, the flock 8 becomes embedded in the wax layer 6. This procedure is then followed for each succeeding color of nylon flock fibers 8 that is to be electrostatically flocked in order to form the desired design, after which the resultant unit is dried. The tips of the exposed flock 8 are printed using conventional screen printing equipment with a water based (40%–60% water) acrylic binder 10. The binder 10 binds the flock 8 and further provides opacity and brilliance by reflecting light. The binder 10 is dusted or powered with a polyurethane hot melt adhesive 12 and the transfer is then air-dried. After brushing and vacuuming excess adhesive 12, the transfer is placed in an infrared dryer to cross link the binder 10 and adhesive 12 to form the multicolor flock transfer in accordance with the present invention.

To apply the transfer to a textile 14, the adhesive surface 12 is positioned on the textile 14. A hot surface heated to a temperature of about 300°–350° F. is pressed against the paper for about 20–30 seconds. The transfer is allowed to cool, preferably to an extent that it can be manipulated by hand, and the paper 4 and wax 6 are removed by peeling the paper 4 from the flock 8. The desired flock design is thus transferred and permanently affixed to the textile. Since the border or periphery of the flock design is composed of a pattern that effectively reduces the density of the flock at the design's edge, the flock at the edge has a tendency to lie flat or become crushed during the heat pressing operation. The flattened flock edge prevents an impression from being formed on the textile during the heat pressing operation.

It is also envisioned that the present invention may be used for making a multi-textured flock transfer by a method which involves applying a release adhesive upon a base sheet; sequentially flocking batches of flock having different, substantially uniform predetermined length through an open section of a barrier, such as a screen, into the adhesive to result in a plurality of predetermined patterns of different lengths of flock arranged to form the predetermined textured design; and applying a binding adhesive to free ends of the flock. Thus, a multi-texture flock transfer including a base sheet having a surface area coated with a release adhesive; patterns of flock of at least two different, substantially uniform, predetermined length having ends adhering to the surface area of the base sheet to form predetermined patterns of different lengths of a textured of a design; and a binding adhesive applied to other ends of the flock, wherein the transfer preferably also includes a layer of supplemental adhesive covering the binding adhesive could be made in accordance with the present invention.

It is believed that the advantages and improved results furnished by the methods and products of the present invention are apparent from the foregoing description of the preferred embodiment of the invention. Various changes and modifications may be made without departing from the spirit and scope of the invention as described in the claims that follow.

We claim:

1. A method of making an appliqué comprising:

A first step of coating a release sheet with a release adhesive;

a second step of flocking flock through an open section of a barrier into said release adhesive to result in at least two patterns of flock arranged to form a predetermined design adhered to said release sheet, said predetermined design having at its periphery a pattern whereby a reduced number of flocking fibers are allowed to adhere to the edge of said predetermined design;

a third step of applying a binding adhesive to free ends of said flock fibers;

a fourth step of transferring at least one said predetermined design of flock to a substrate material; and a fifth step of affixing said substrate material with said predetermined design of flock to an article.

2. The method of claim 1 wherein said periphery pattern of said second step consists of a pattern of dots.

3. The method of claim 1 wherein said article of said fifth step consists essentially of acrylic material.

4. The method of claim 1 wherein said article of said fifth step consists essentially of vinyl material.

5. The method of claim 1 wherein said article of said fifth step is an article of clothing.

* * * * *